US007806205B2

(12) United States Patent
Böck

(10) Patent No.: US 7,806,205 B2
(45) Date of Patent: Oct. 5, 2010

(54) EARTH DRILLING DEVICE

(76) Inventor: Alexander Böck, Grafrather Str. 53, 82288 Kottgeisering (DE)

( * ) Notice: Subject to any disclaimer, the term of this patent is extended or adjusted under 35 U.S.C. 154(b) by 0 days.

(21) Appl. No.: 12/425,648

(22) Filed: Apr. 17, 2009

(65) Prior Publication Data

US 2010/0000796 A1 Jan. 7, 2010

(30) Foreign Application Priority Data

Jul. 4, 2008 (DE) ..... 20 2008 009 050 U

(51) Int. Cl.
*E21B 1/02* (2006.01)
*E21B 17/18* (2006.01)

(52) U.S. Cl. ..... 175/170; 213/424; 213/209

(58) Field of Classification Search ..... 175/213, 175/424, 209

See application file for complete search history.

(56) References Cited

U.S. PATENT DOCUMENTS

| | | | | |
|---|---|---|---|---|
| 3,554,293 A | | 1/1971 | Aman et al | |
| 4,293,041 A | * | 10/1981 | Holmstadt et al. | 172/39 |
| 5,174,394 A | * | 12/1992 | Fischer et al. | 175/315 |
| 5,535,836 A | * | 7/1996 | Cagianut et al. | 175/213 |
| 6,854,524 B1 | * | 2/2005 | Williams | 172/13 |
| 7,185,720 B1 | | 3/2007 | Menna | |
| 7,407,020 B2 | * | 8/2008 | Gleitman et al. | 175/57 |

FOREIGN PATENT DOCUMENTS

| | | |
|---|---|---|
| DE | 25 30 531 C2 | 1/1977 |
| DE | 203 01 785 U1 | 4/2003 |

* cited by examiner

*Primary Examiner*—Jennifer H Gay
*Assistant Examiner*—Yong-Suk Ro
(74) *Attorney, Agent, or Firm*—Antonelli, Terry, Stout & Kraus, LLP.

(57) ABSTRACT

An earth drilling device having a rotary drive and a drilling head connected to the rotary drive via a shaft is disclosed. The shaft runs at least partially axially along a pipe with two pipe ends, the first pipe end of which is connectable to a vacuum source and the second pipe end of which is provided with a pipe opening over which the drilling head at least partially projects. The drilling head is provided with at least two fillet sections connected to the shaft, which are attached to the shaft in radial extension and in projection along the axis of the pipe only partly cover the pipe opening. The fillet sections are each connected to an axially oriented surface section, which contacts the inner wall of the pipe in a gliding manner or contacts an inner wall of a sleeve coaxially connected to the second pipe end when the drilling head rotates. The axially oriented surface sections are each connected to a limb which axially projects over the pipe or the sleeve.

20 Claims, 8 Drawing Sheets

EARTH DRILLING DEVICE

BACKGROUND OF THE INVENTION

1. Field of the Invention

The present invention relates to an earth drilling device having a rotary drive and a drilling head connected to the rotary drive via a shaft.

2. Description of the Prior Art

For local earth excavation, especially in cases in which there is only very little excavation room, manual tools such as shovels, pickaxes and so-called universal joint shovels with two shovel blades designed with a joint to grasp the earth are used.

Moreover, the state of the art are drills which have correspondingly dimensioned spindle drilling heads and which perform vertical excavation based on Archimedes' principle. Such type motor-driven devices are heavy and expensive.

U.S. Pat. No. 7,185,720 describes a manual drill for local earth excavation which has a suction line connected to a vacuum source. The pipe is surrounded in axial direction by four sturdy longitudinal rods. The bottom ends of the rods taper to a point as a scraping tool. The suction pipe end is disposed at a distance opposite the scraping tools and is able to correspondingly vacuum off the earth loosened by the longitudinal rods through the suction line. The rod ends opposite the tapering scraping tools run into handle-like designed cross struts which permit manual handling of the drilling tool.

U.S. Pat. No. 5,535,836 describes a drilling device for drilling bore holes in the earth. The device is provided with an external pipe connected to a vacuum source which is provided with a saw-toothed structure at the end of the pipe facing the earth. An internal pipe is borne in the interior of the external pipe in a manually or motor driven rotatable manner which is provided with at least one outlet nozzle for a preferably liquid or gaseous material flow by means of which the earth material can be loosened. The loose and broken off earth material is correspondingly removed by the vacuum applied along the external pipe.

Moreover U.S. Pat. No. 3,554,293 describes a device for weeding and edging, in particular, lawn surface. The device is provided at the end of a motor-driven shaft with a cutting tool which is surrounded by a can-like designed protective case. Close to the surface material removal is realized by lowering the cutting tool relative to the protective case.

DE 25 30 531 C2 describes a rotatable drilling tool for earth drilling machines in which the earth loosened by a drilling tool attached to the end of a rotatably borne shaft, is conveyed to a pail-like container disposed downstream along the shaft. When the container is full, the drilling tool closes the pail that is otherwise designed open at the bottom. In this manner the loosened earth can be removed in portions from the thereby produced hole.

Earth excavation using an earth-hole cutter according to DE 203 01 785 U1 occurs according to a similar principle. In the DE 203 01 785 U1 a container designed open at the bottom is also filled with loosened earth by vertically lowering a drilling tool. The earth however is pressed so compact inside the container that the container can be removed vertically from the earth hole.

SUMMARY OF THE INVENTION

The present invention is an earth drilling device which is easy to operate and is suited, in particular, for private gardening needs and building needs and therefore presents a cost-effective alternative to present systems. The earth drilling device permits the user to easily and quickly produce holes in the earth with dimensions of one meter in depth and several decimeters in diameter.

According to the invention, an earth drilling device having a rotary drive and a drilling head connected to the rotary drive via a shaft runs at least partially axially along a pipe with two pipe ends. The first pipe end is connectable to a vacuum source and the second pipe end is provided with a pipe opening over which the drilling head at least partially projects. The drilling head is provided with at least two fillet sections connected to the shaft, which are attached to the shaft in radial extension and in projection to the axis of the pipe only partly cover the pipe opening. The fillet sections are each connected to an axially oriented surface section whose surface, which is radially oriented outward, contacts the inner wall of the pipe in a gliding manner or contacts an inner wall of a sleeve coaxially connected to the second pipe end when the drilling head rotates. The axially oriented surface sections each are connected to a limb which axially projects over the pipe or the sleeve.

In an advantageous preferred embodiment, the limbs are each inclined radially outward in relation to the axially oriented surface sections in such a manner that the limbs project radially over the outer diameter of the pipe and/or over the outer diameter of the sleeve.

BRIEF DESCRIPTION OF THE DRAWINGS

The earth drilling device according to the invention is explained and described in more detail with reference to the accompanying drawings. With regard to the nomenclature used herein, the drilling head is referred to as a scraper hoop having protruding sections such as fillet sections, axial surface sections and limbs.

The present invention is described by way of example in the following drawings without being limited to the preferred embodiments with reference to the drawings.

DETAILED DESCRIPTION OF THE INVENTION

Figure 1A:
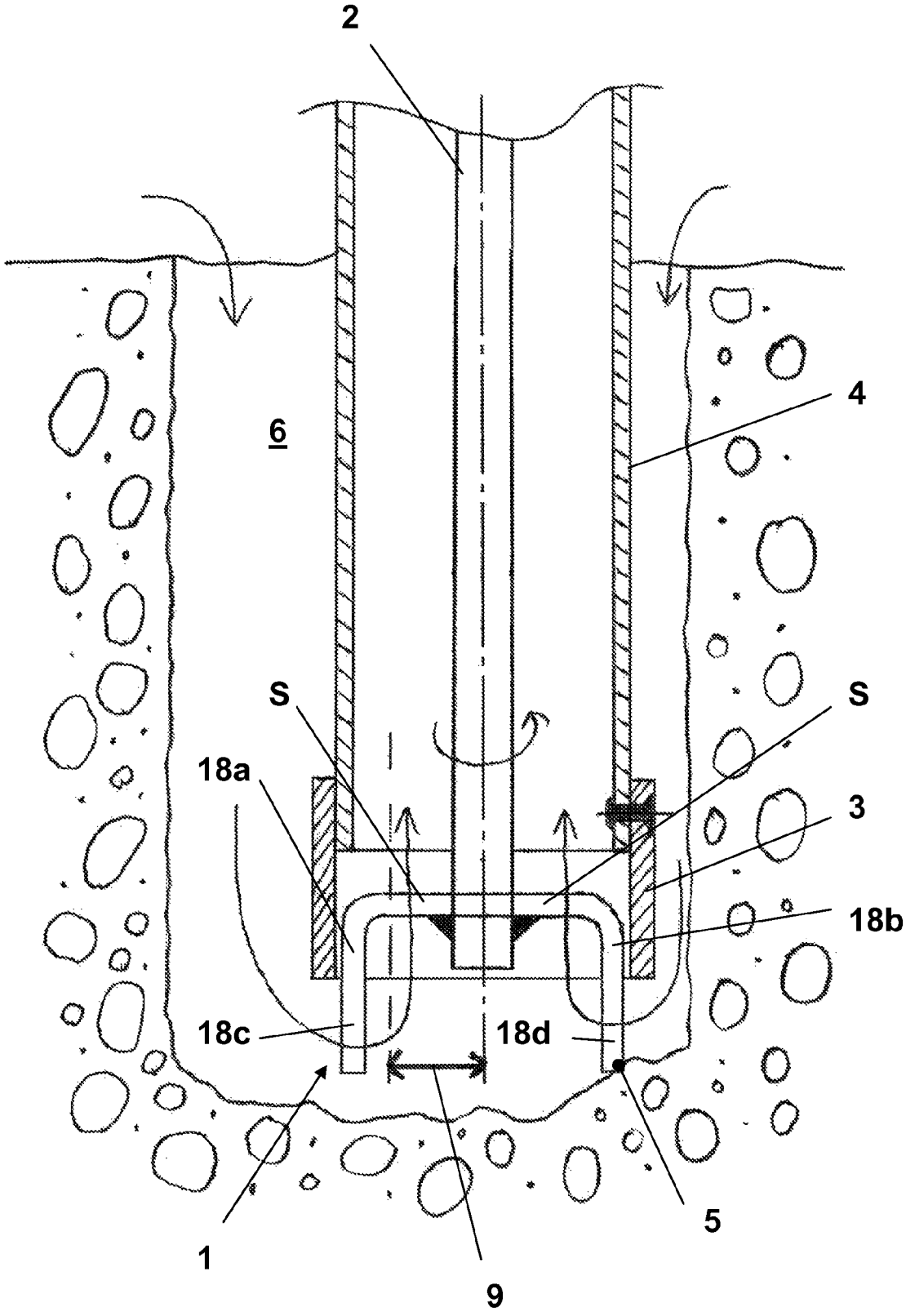
FIGS. 1*a* and *b* show longitudinal sections of the earth drilling head according to two earth drilling alternative embodiments according to the invention.
Figure 2:
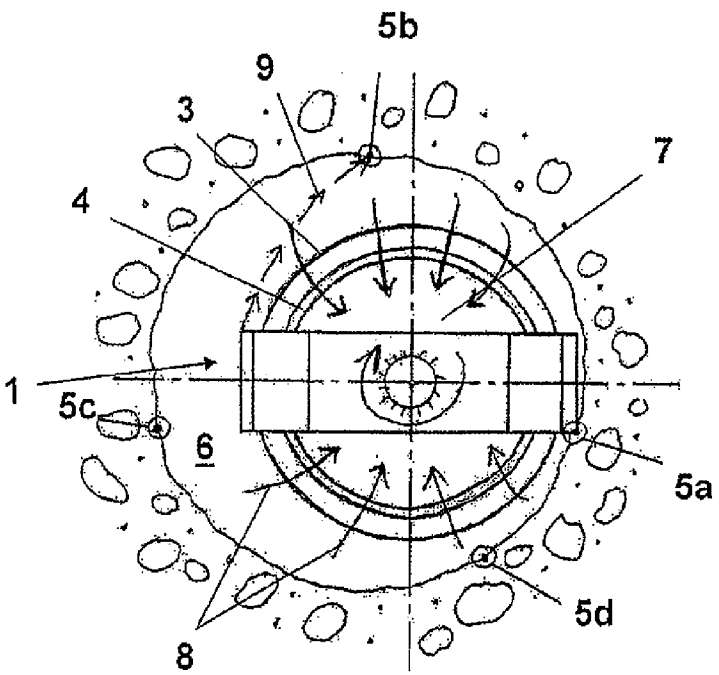
FIG. 2 shows an axial top view of the earth drilling head according to the earth drilling device alternative embodiment shown in FIG. 1*b;*
Figure 1B:
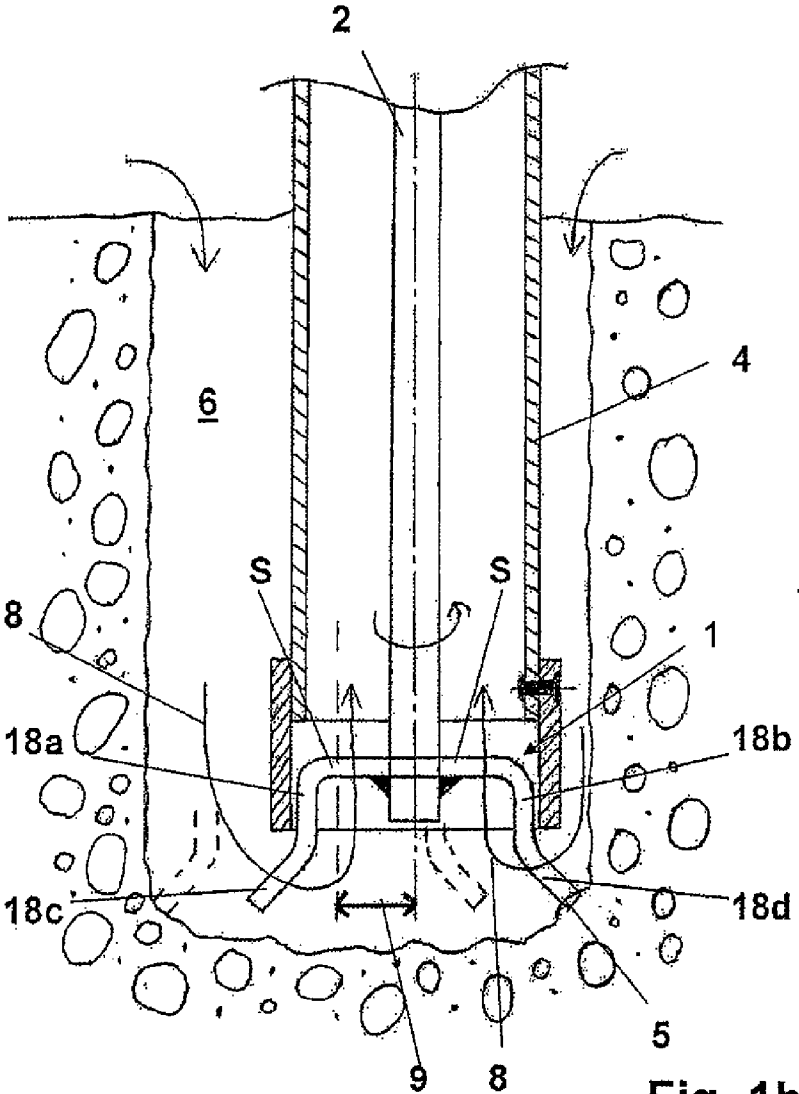

FIG. 1*a* shows a longitudinal section of an earth drilling head according to the invention and FIG. 1*b* shows a longitudinal section of an alternative embodiment of an earth drilling head according to the invention and FIG. 2 shows an axial top view of the earth drilling head. The earth drilling head according to FIG. 1*a* differs from that of FIG. 1*b* only in the design of the scraper hoop 1 described herein so that all further descriptions refer to FIGS. 1*a* and *b* and FIG. 2.

A scraper hoop 1 is set into rapid rotation by a bending and torsionally elastic shaft 2. A suction pipe 4 is held centered over the scraper hoop 1 via a steel cylinder liner 3, which reduces wear. The rotation, the elasticity and the one-sided knocking of the scraper hoop 1 at the point of contact 5 in the bore hole 6 force the scraper hoop into a sort of wobble-scrapping movement 9, yielding new points of contact 5 with the numbers 5*a, b, c, d*, etc. (FIG. 2) due to which the "knocked out" diameter of the bore hole 6 becomes larger than the diameter of the scraper hoop 1 and uniformly deeper drilling becomes possible. This "scraping movement" loosens all the fine-grain material of the ground, which then is immediately removed from the bore hole 6 via the suction cross section 7. Moreover, the turning hoop 1 prevents larger stones from blocking the suction pipe 4 as they are immediately ejected from the suction cross section 7.

Through the larger bore hole produced by the scraping movement flows scavenging air 8 into the bore hole 6 and transports the knocked-loose earth through the suction pipe 4 to an excavated material collector 10. The scavenging air 8 is drawn from the surroundings of the bore hole into the bore hole by the vacuum created by drawing off the air in the bore hole.

Moreover, the scraping and knocking movement generates a bending vibration of the shaft 2 and a joggling of the suction pipe 4 which prevents sticky material (e.g., moist clay) from sticking to the inner walls of the suction pipe 2.

Large stones remain in the bore hole, which can be removed later with a shaftless suction pipe or by hand.

The design of the scraper hoop 1 of the preferred embodiment shown in FIG. 1*a* is basically U-shaped. Thus the scraper hoop 1 has two fillet sections (s) connected to the shaft (2). The fillet sections are attached in radial extension to shaft (2) and in projection to the axis of the pipe only partly cover the pipe opening. The fillet sections (S) each gradually change preferably one-piece into an axially oriented surface section (18*a* and 18*b*) whose radially outward oriented surface upon rotation of the drilling head comes in gliding contact with the inner wall of the pipe or an inner wall of a sleeve (3) which is coaxially connected to the second pipe end. The axially oriented surface sections (18*a* and 18*b*) are designed axially extended in such a manner that they each gradually change preferably as one-piece into limbs (18*c* and 18*d*) which axially project over the pipe (2) or over the sleeve (3) or are connected with the same.

In contrast to this, the scraper hoop 1 of the preferred embodiment shown in FIG. 1*b* has two limbs or axially projecting sections (18*c* and 18*d*) which are outwardly inclined in relation to the axially oriented surface sections (18*a* and 18*b*). The limbs radially project over the outer diameter of the pipe (4) and/or of the sleeve (3). Such a type of scraper hoop is described in more detail in FIGS. 4 and 5.

Figure 3A:
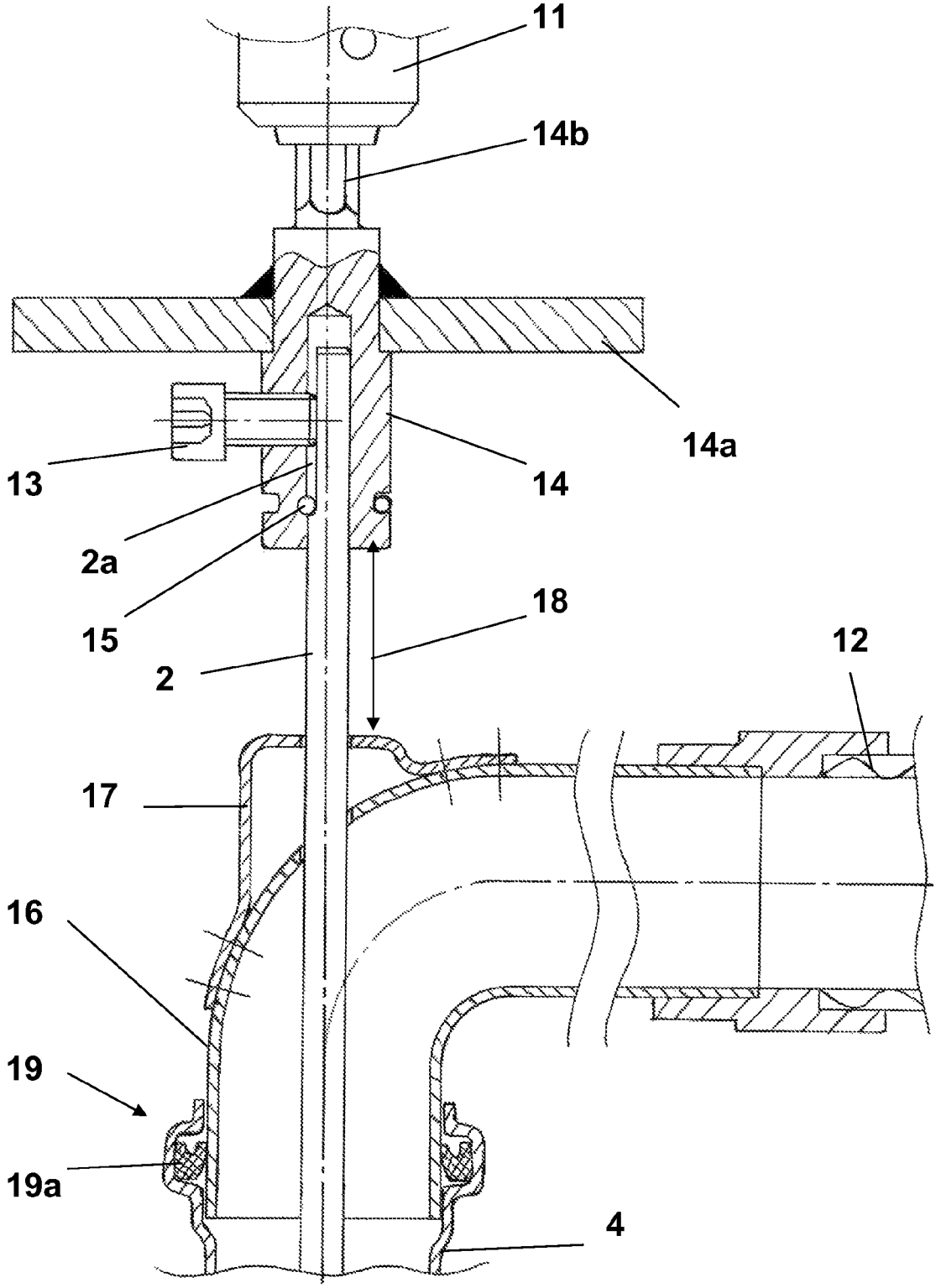
FIGS. 3*a* and *b* show cross sectional representations of the connecting section of the shaft drive connecting to the flexible suction pipe according to the invention.
Figure 11:
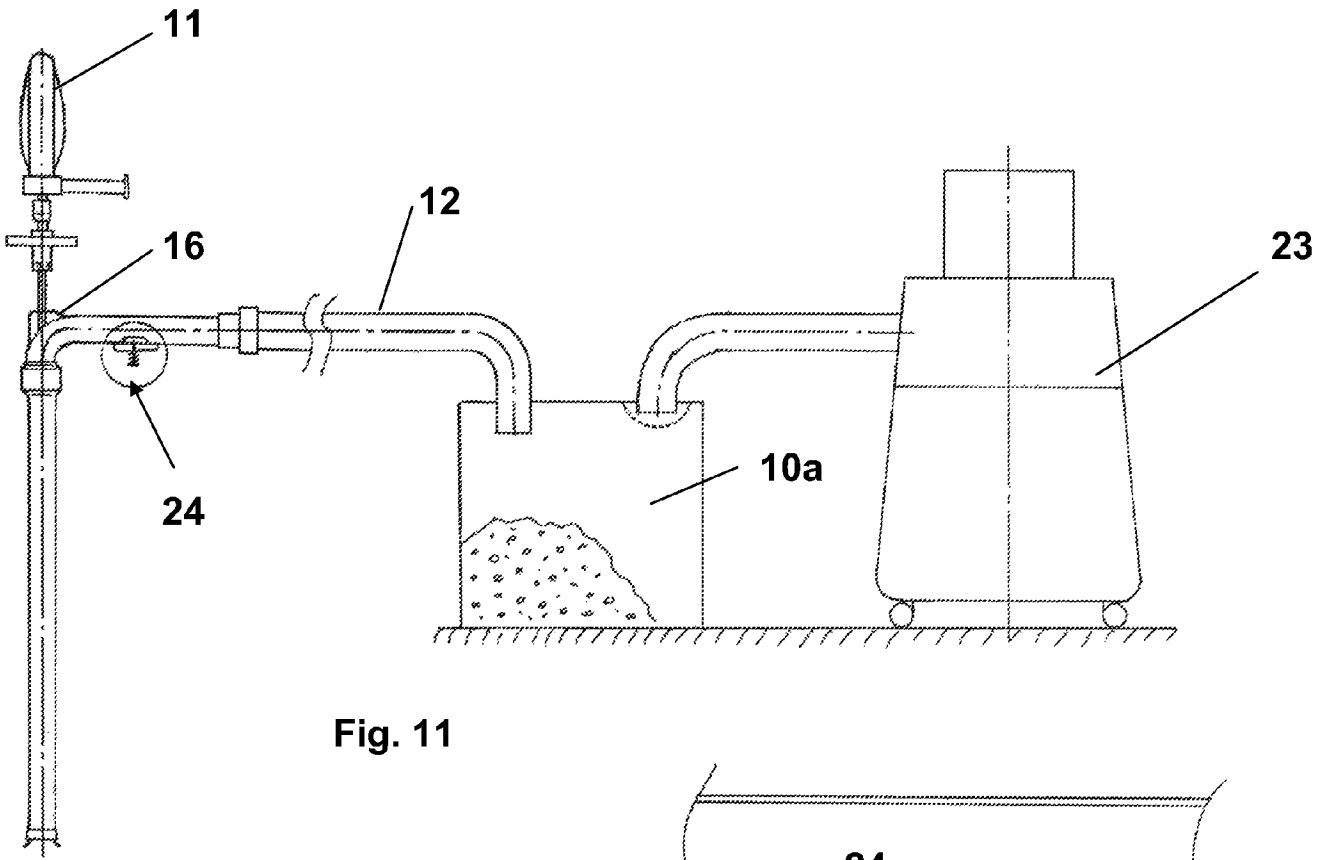
FIG. 11 shows an overall representation of an earth drilling system according to the invention.

FIGS. 3*a* and *b* show a version of the drive of the shaft 2 and the connection to a flexible suction tube 12 to an excavated material collector 10, which is shown in FIG. 11.

According to the preferred embodiment of FIG. 3*a*, the shaft 2 is clamped along a narrowing 2*a* by a binding screw 13 in a clamp fit 14 with an integrated flywheel 14*a*. The clamp 15 prevents the shaft 2 from slipping out due to friction during attachment and aligns the narrowing 2*a* to the screw 13.

Figure 3B:
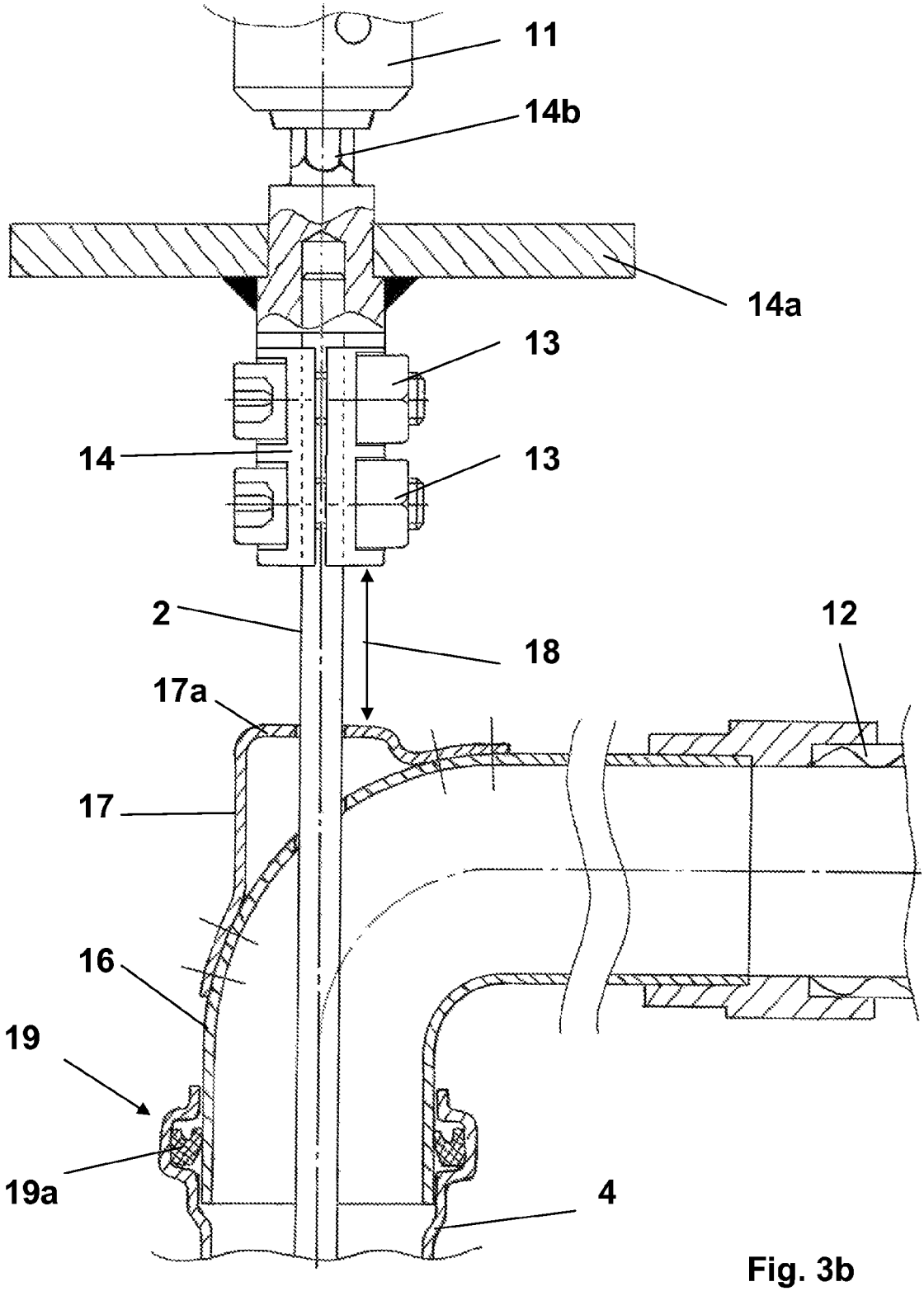

In contrast to this, in the preferred embodiment shown in FIG. 3*b*, the shaft is clamped by a clamp mechanism with two fastening screws 13 in a clamp fit with an integrated flywheel 14*a*.

The clamp fit 14 is firmly clamped by a hexagonal bit 14*b* in an electric hand drill 11.

The flywheel 14*a* and the shaft 2, which is elastic relative to torsion, decouples the drill 11 from the rotating knocking of the scraper hoop 1, yielding thereby not only a relatively smooth running of the drill 11 which is beneficial not only for better handling but also for not overtaxing the mechanics of the drill.

In order to replace the shaft 2, only two screws 13 need to be loosened and the clamp fit 14 pulled off. Then the shaft 2 with the integrated scraper hoop 1 is pulled out of the suction pipe 4 in the opposite direction.

Figure 5:
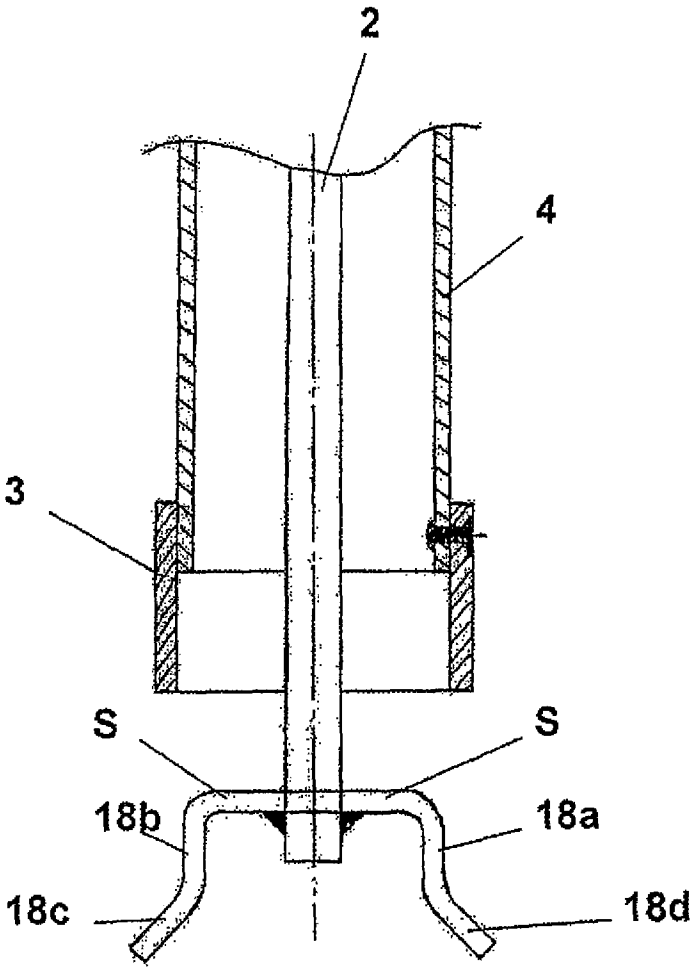
FIG. 5 shows a longitudinal section of an earth drilling head with the earth drilling head pushed axially out of the suction pipe according to the invention.

A hoop 17 is attached to an elbow piece 16 which centers the elbow piece 16 in relation to shaft 2. The hoop 17 is designed in such a manner that a surface 17*a* lies opposite the clamp fit 14 in parallel at a defined distance 18. The distance 18 allows the suction pipe 4 including the elbow piece 16 to draw to the clamp fit 14 and in this manner to release the cylinder liner 3 relative to the scraper hoop 1. The released position is shown in FIG. 5.

In addition, a sliding clutch 19 is attached to the connection between the elbow piece 16 and the suction pipe 4. The sliding clutch 19 is realized here by way of example by a rubber ring 19*a*, which forms a friction connection between the elbow piece 16 and the suction pipe 4. The sliding clutch designed in this manner permits moreover easy replacement of the suction pipe 4, when it is worn.

In the rare case that despite the ejecting movement of the scraper hoop 1, a stone is stuck in the suction cross section 7, the sliding clutch 19 prevents abrupt "seizure" of the device. After switching off the hand drill 11, by drawing back the scraper hoop 1 over the length of the path 18 of the suction pipe 4, the scraper hoop 1 can be released relative to the cylinder liner 3 and in this way the stone that is stuck can be easily and quickly removed.

If there is already a stone in the suction pipe 4 that is stuck with the shaft 2, pushing back and releasing also permits easy removal as the suction pipe 4 can then be tipped against the shaft 2.

After removal of the stone that is stuck, the suction pipe 4 is returned to the centered position by setting the scraper hoop 1 into rotation again and the suction pipe 4 with the elbow piece 16 is pushed slightly in the direction of the scraper hoop 1.

Due to the closed round shape of the scraper hoop 1 in the direction of the suction pipe 4, the cylinder liner 3 catches itself automatically and centers in this manner the suction pipe 4 relative to the rotating scraper hoop 1. This catching procedure is also possible during drilling so that scraping can be conducted without simultaneous extraction. This is for example advantageous if the bore hole should be widened laterally.

Figure 4B:
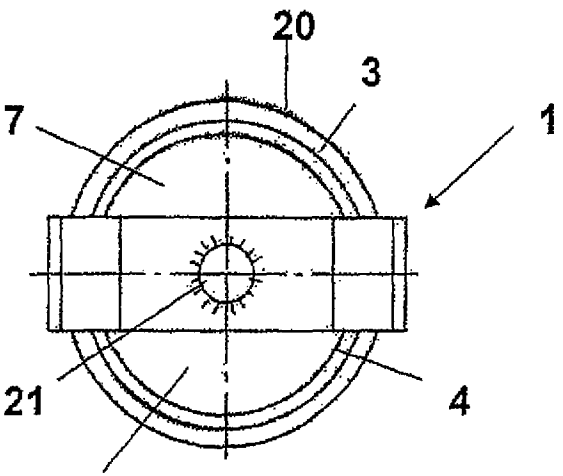
FIG. 4 shows an axial top view and a longitudinal section of an earth drilling head according to the invention.
Figure 4A:
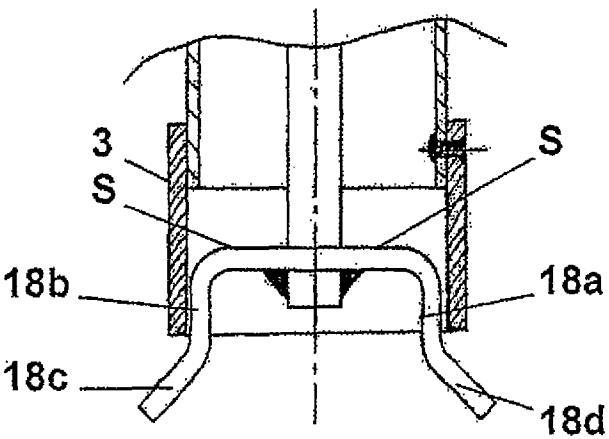

FIG. 4 shows once more the scraper hoop 1 with the suction pipe 4 according to the preferred embodiment of the FIG. 1*b*. Decisive for the function is the combination of a joggling/knocking scraper hoop 1 and the clearing function of suction cross section 7.

The at least two axially parallel surfaces 18*a* and 18*b* of the scraper hoop 1 which are connected by the fillet sections S to the shaft 2, for example by a welding joint, allow gliding of the scraper hoop 1 on the inner surface of the cylinder liner 3. In this manner the suction pipe 4 can be held centered over the scraper hoop 1 due to the shape of the suction cross section 7 being unchanged. This is an important factor to prevent stones from blocking the cross section 7. In addition, due to the bent limbs 18*c* and 18*d*, which rotate openly and quickly in a direction opposite to the extraction direction, practically all the stones which do not fit through the suction cross section 7 are ejected from the extraction area.

The limbs or axially projecting sections 18*c* and 18*d* project further over the outer diameter 20 of the suction pipe 4 and support in this manner the required joggling and knocking function for breaking off solid material. The projecting shaft journal 21 acts additionally to large stones away from the suction cross section 7, and it facilitates the immediate ejection of the stines again.

Figure 6B:
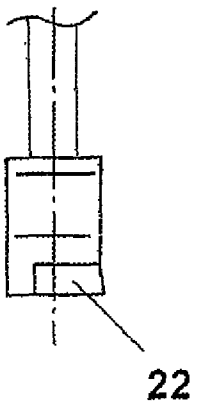
Figure 6A:
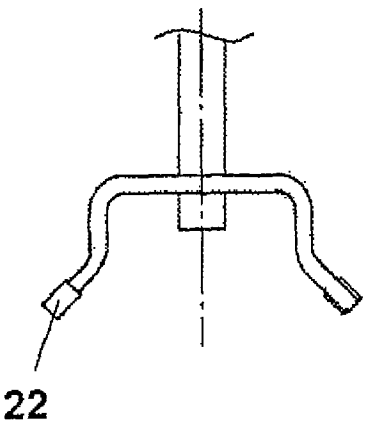

FIG. 6 shows a variant of the scraper hoop with soldered on hard metal blades 22 to extend service life.

Figure 7:
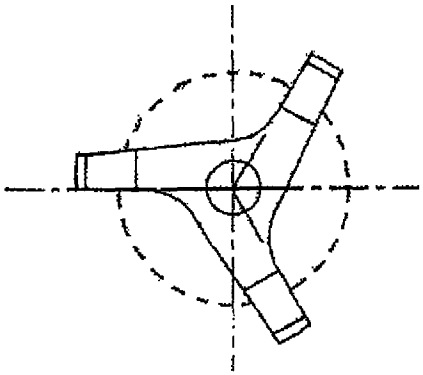

FIG. 7 shows a variant with three blades which can be advantageous depending on the properties of the ground. It should be noted that more blades are also possible, which are not illustrated here.

Figure 8B:
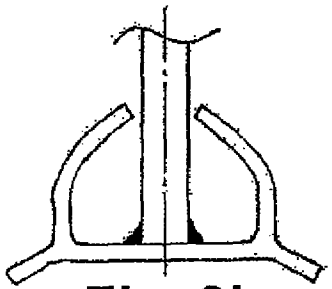
FIGS. 6-8 show alternative preferred embodiments of the scraper hoops on the earth drilling head according to the invention.
Figure 8A:
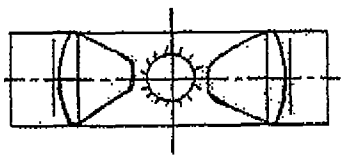

FIG. 8 shows a variant of the scraper hoop 1 as a cast construction with a welded on shaft 2. One can see here especially the round shape of the rear side which permits catching the cylinder liner 3.

Figure 9:
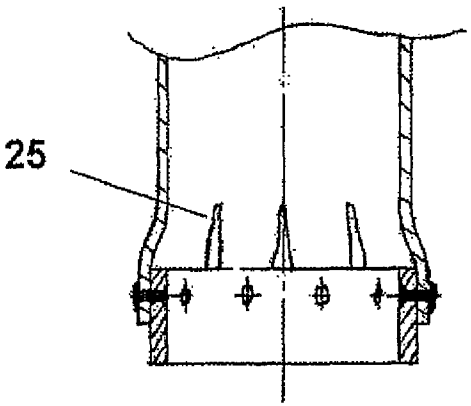

FIG. 9 shows a variant of the attachment of the cylinder liner 3 to the suction pipe 4 with axial slits 25 and rivets.

Figure 10:
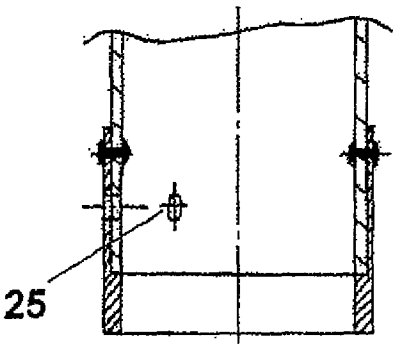
FIGS. 9 and 10 show alternative means of attaching a cylinder liner on the suction pipe according to the invention.

FIG. 10 shows a version with a partly reduced cylinder liner with rivets.

FIG. 11 shows a complete configuration with the hand drill 11, extracted material collector 10 and industrial type vacuumer 23. The industrial type vacuumer 23 draws off air from the extracted material collector via a coarse sieve 10*a*. The coarse sieve 10*a* prevents large stones from getting into the filter sack of the industrial type vacuumer 23 and filling it quickly. This separation allows depositing large amounts of excavated material in the excavated material collector without fine dust escaping to the surrounding area. It is retained in the filter sack.

To increase the suction performance of the scraper hoop 1, in addition a multiplicity of industrial type vacuumers 23 can be connected via the coarse sieve 10*a* to the excavated material collector 10.

Figure 12:
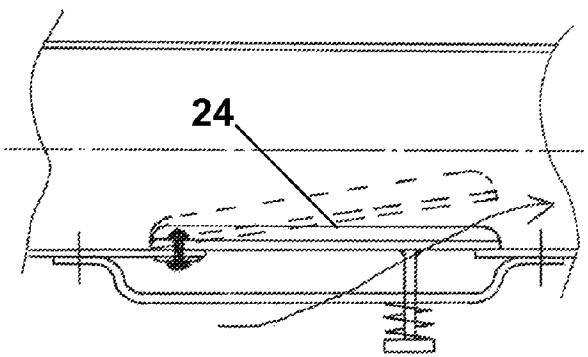
FIG. 12 shows the safety flap on the suction tube according to the invention.

It is possible that if the air flow in the suction tube 12 is too low, the to-be-conveyed material can no longer be transported. In order to prevent this, a spring-loaded flap 24 can be placed just behind the elbow of the suction pipe (16) (see FIG. 12), which opens when the inflow of air over the scraper hoop 1 is too low, that is the vacuum in the suction tube 12 is too great.

For the same reason, as shown in FIG. 9 and FIG. 10, air-inflow opening 25 can be placed directly behind the scraper hoop 1 (not depicted).

Figure 13:
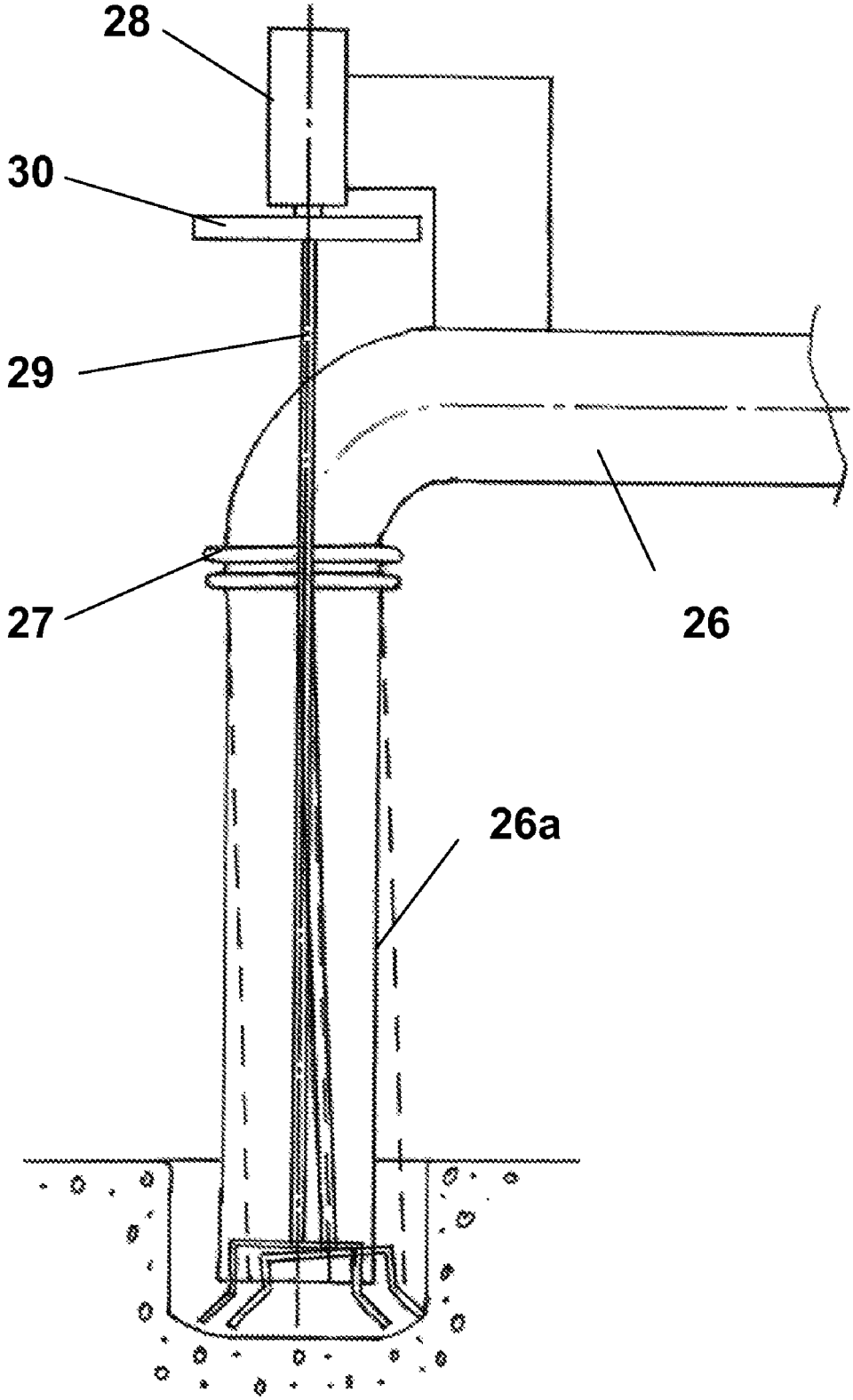
FIG. 13 shows a variant of an extraction loader with a hydraulically controlled suction pipe for drilling large holes according to the invention.

FIG. 13 shows a variant of an extraction loader with a hydraulically controlled suction pipe 26 for drilling large holes from a truck or a train car.

In this instance, the suction pipe 26 cannot vibrate as it is rigidly affixed to a hydraulic arm (not depicted). In order to nonetheless permit the joggling and scraping movement, the vertical part 26*a* of the suction pipe is borne in an articulated manner via an elastic bellow 27.

If a drive motor 28 is rigidly affixed, in this case an elastic drive shaft 29 is required to permit the joggling function. A flywheel 30 is also attached in this case directly to the drive motor 29 to protect it.

POSSIBLE APPLICATIONS excavation of earth holes, for example, for placing fence posts or posts of any sort digging holes through walls for installing electrical wiring or water pipes digging in inaccessible places in general digging and extraction of tunnels obstructed by mud (moist or dry)

cleaning hollow spaces in general

What is claimed is:

1. An earth drilling device comprising:

a rotary drive coupled to a drilling head by a shaft;

a pipe along which the shaft at least partially extends including a first end for connection to a vacuum source and a second end beyond which the drilling head at least partially extends; and the drilling head comprises a scraper hoop which is rotated by the rotary drive to contact and dislodge earth without a cutting liquid and including at least two radial sections which are connected to the shaft and radially extend outward from the shaft and only partially cover an inner cross section of the second end, at least two axially oriented surface sections which are respectively connected to a different one of the at least two radial sections which, upon rotation of the drilling head, glide in contact with an inner wall of the pipe or an inner wall of a coaxial sleeve connected to the second end and at least two axially projecting sections which respectively are connected to a different one of the axially oriented surface sections which extend beyond the pipe or the sleeve to contact and dislodge the earth.

2. The earth drilling device according to claim 1, wherein:

the axially projecting sections are inclined radially outward in relation to the axially oriented surface sections and over an outer diameter of the pipe and/or the sleeve.

3. The earth drilling device according to claim 2, wherein:

the rotary drive is a hand drill with a chuck for gripping the shaft.

4. The earth drilling device according to claim 3, wherein:

a flywheel is connected to the shaft proximate to the rotary drive.

5. The earth drilling device according to claim 3, wherein:

the shaft is torsionally elastic and/or axially elastic.

6. The earth drilling device according to claim 2, wherein:

a flywheel is connected to the shaft proximate to the rotary drive.

7. The earth drilling device according to claim 2, wherein:

the shaft is torsionally elastic and/or axially elastic.

8. The earth drilling device according to claim 1, wherein:

a flywheel is connected to the shaft proximate to the rotary drive.

9. The earth drilling device according to claim 8, wherein:

the shaft is torsionally elastic and/or axially elastic.

10. The earth drilling device according to claim 1, wherein:

the shaft is torsionally elastic and/or axially elastic.

11. The earth drilling device according to claim 1, wherein:

the sleeve comprises a wear-resistant material and the pipe is plastic.

12. The earth drilling device according to claim 1, wherein:

the first end is connected to an elbow via a sliding clutch, the elbow including a bent section with an opening through which the shaft extends; and the elbow has an opening defining an opening surface including a surface normal extending through an axis of the pipe with the normal defining an angle relative to the axis of the pipe not equal to 0°.

13. The earth drilling device according to claim 12, wherein:

the angle is 90°.

14. The earth drilling device according to claim 1, wherein:

a transition between the axially oriented surface sections and the axially projecting sections includes a rounded transition contour which supports axial gliding of the drilling head into the pipe or into the sleeve.

15. The earth drilling device according to claim 12, wherein:

the opening of the elbow is coupled to the vacuum source.

16. The earth drilling device according to claim 13, wherein:

the opening of elbow is coupled to the vacuum source.

17. The earth drilling device according to claim 1, wherein:

the shaft is axially movable along the pipe.

18. The earth drilling device according to claim 1, wherein:

metal blades are attached in the axially projecting sections.

19. The earth drilling device according to claim 1, wherein:

each radial section is connected to one of the axially oriented surface sections which is connected to one of the axially projecting sections in one piece.

20. The earth drilling device according to claim 1 wherein:

the scraper hoop is U-shaped.

* * * * *